United States Patent [19]

Winters et al.

[11] Patent Number: 4,629,655

[45] Date of Patent: Dec. 16, 1986

[54] SIZE COMPOSITION

[75] Inventors: James C. Winters; Robert A. Mooth; Frank T. Orthoefer, all of Decatur, Ill.

[73] Assignee: A. E. Staley Manufacturing Company, Decatur, Ill.

[21] Appl. No.: 749,918

[22] Filed: Jun. 27, 1985

[51] Int. Cl.[4] ..... D21D 3/00

[52] U.S. Cl. ..... 428/402; 162/158; 162/175; 428/403; 428/426; 428/443; 428/474.4; 428/480; 428/511; 428/522

[58] Field of Search ..... 162/158, 175; 428/357, 428/402, 403, 426, 443, 474.4, 480, 511, 522

[56] References Cited

U.S. PATENT DOCUMENTS

| | | | |
|---|---|---|---|
| Re. 29,960 | 4/1979 | Mazzarella et al. | 162/158 |
| 3,459,632 | 8/1969 | Caldwell et al. | 162/175 |
| 3,524,796 | 8/1970 | Yui et al. | 162/175 |
| 3,562,103 | 2/1971 | Moser et al. | 162/175 |
| 3,854,970 | 12/1974 | Aitken | 106/210 |
| 3,968,005 | 7/1976 | Wurzburg | 162/158 |
| 4,029,544 | 6/1977 | Jarowenko et al. | 162/175 |
| 4,127,418 | 11/1978 | Bateman et al. | 106/213 |
| 4,152,312 | 5/1979 | Sackmann et al. | 524/549 |
| 4,212,704 | 7/1980 | Durand et al. | 162/175 |
| 4,268,352 | 5/1981 | Cosper et al. | 162/191 |
| 4,305,860 | 12/1981 | Lovine et al. | 526/287 |
| 4,316,977 | 2/1982 | Gude et al. | 526/272 |
| 4,381,367 | 4/1983 | von Bonin et al. | 524/549 |
| 4,431,826 | 2/1984 | Sweeney | 549/255 |
| 4,452,978 | 6/1984 | Eastman | 536/111 |
| 4,514,229 | 4/1985 | Sato et al. | 106/135 |

OTHER PUBLICATIONS

J. E. Maher, *The Role of Alkenyl Succinic Anhydride in Alkaline Paper-Making,* TAPPI Proceedings (1982), pp. 45–50.

R. F. Sirois, *High Ash Paper-Making with Alkaline Sizing,* TAPPI Proceedings (1982), pp. 63–68.

*Primary Examiner*—William J. Van Balen

*Attorney, Agent, or Firm*—Michael F. Campbell; James B. Guffey; Philip L. Bateman

[57] ABSTRACT

Sizing agents are combined with a solid form with a size retention aid to more effectively deliver the size to a substrate.

22 Claims, No Drawings

SIZE COMPOSITION

BACKGROUND OF THE INVENTION

1. Field of the Invention

This invention relates to sizing of substrates such as cellulose.

2. Description of the Art Practices

The production of various substrates such as cellulose into paper requires large volumes of water. Accordingly, many of the substrates, even when dried, are still substantially hydrophilic in character and thus may tend to tear or decompose rapidly in the presence of water.

The problem of decomposition of a substrate such as paper in the presence of water is controlled by sizing in the substrate. A size is a material which is itself hydrophobic in nature and which when applied to the substrate causes the substrate to lose its hydrophilic character thereby repelling water. A material which is extremely lightly sized would be toilet paper whereas a corrugated or cardboard box is ordinarily highly sized. Therefore, the amount of size delivered within the present invention is determined by the end-use of the substrate.

Various substrates which may be sized are described in U.S. Pat. No. 4,029,544 issued June 14, 1977 to Jarowenko et al. The substrates suggested by Jarowenko et al include materials such as cellulose (paper); synthetic materials such as polyamides, polyesters and polyacrylic resins, and mineral fibers such as asbestos or glass and mixtures thereof. All of the foregoing materials may be treated with a size to strengthen the substrate. Substrates which are not particularly hydrophilic may be strengthened or the migration of water through the substrate lessened by utilizing a size on a substrate.

It is suggested that the reader review U.S. Pat. No. 3,459,632 issued Aug. 5, 1969 to Caldwell et al for polymers containing both anionic and cationic groups which are useful as sizing aids. A disclosure of cationic polymers useful in sizing include those disclosed in U.S. Pat. No. 4,268,352 issued May 19, 1981 to Cosper et al. Further disclosures of quaternary ammonium starch ethers containing anionic covalent phosphorus moieties are located in Moser et al issued Feb. 9, 1971 as U.S. Pat. No. 3,562,103.

A disclosure of stable, pumpable, solvent-free colloidal polyampholite latices are described in U.S. Pat. No. 4,305,860 issued Dec. 15, 1981 to Iovine et al. The amphoteric starches of Iovine et al are useful herein when in their cationic form. U.S. Pat. No. 3,854,970 issued Dec. 17, 1974 to Aitken describes cationic starches which may be utilized in the sizing of paper. Sweeney in U.S. Pat. No. 4,431,826 issued Feb. 14, 1984 describes various quaternary (cationic) polymers for use in paper sizing.

Ketene dimer emulsions useful as internal paper sizes are described in U.S. Pat. No. 3,524,796 issued Aug. 18, 1970 to Yui. Yui further discloses the use of cationic potato starch in the application of size to a paper substrate.

The use of anhydrides as sizes in paper making are discussed in an article entitled *The Role of Alkenyl Succinic Anhydride In Alkaline Paper-Making.* The foregoing paper was presented by Maher at the 1982 Paper-Makers Conference and was reprinted in the 1982 TAPPI Procedings at pages 45–50. A further disclosure of alkaline sizing processes is reported in *High Ash Paper-Making With Alkaline Sizing* presented by Rolland F. Sirois at the 1982 Paper-Making Conference. The foregoing article was reported in the 1982 TAPPI Procedings at pages 63–68.

Various types of anhydride paper sizes are known such as those disclosed in U.S. Re. Pat. No. 29,960 issued Apr. 10, 1979 to Mazzarella et al. Further disclosures of anhydride paper sizes are described in U.S. Pat. No. 4,514,229 issued Apr. 30, 1985 to Sato et al.

Several sizing agents are described in U.S. Pat. No. 4,381,367 issued Apr. 26, 1983 to von Bonin et al. Copolymers of maleic anhydride dicyclopentadiene and vinylcyclohexene as anionic paper sizing materials are described in U.S. Pat. No. 4,316,977 issued Feb. 23, 1982 to Gude et al. Sizing agents based on maleic, phthalic or succinic anhydride or combinations thereof are described in U.S. Pat. No. 4,212,704 issued July 15, 1980 to Durand et al.

U.S. Pat. No. 4,152,312 issued May 1, 1979 to Sackmann et al describes anionic sizes for paper based on esters or semi-esters of diisobutylene/maleic acid anhydride copolymers in the form of their alkali, amine or ammonium salts. Bateman et al in U.S. Pat. No. 4,127,418 issued Nov. 28, 1978 describes various sizing agents based on monoesters of benzene carboxylic acid anhydride. Anhydrides of vinylidene olefin are disclosed in U.S. Pat. No. 3,968,005 issued July 6, 1976 to Wurzburg.

It has not yet been appreciated that the level of sizing agent, particularly those based on anhydrides, may be substantially reduced without adversely affecting the properties of a substrate through the use of the compositions of the present invention. Moreover, the effectiveness of the size may be substantially increased through the processing suggested in the present invention. The delivery and retention of the size to the substrate is enhanced by the present invention.

To the extent that the references reported herein are applicable to the present invention, they are herein incorporated by reference. Percentages and ratios are by weight, temperatures are in degrees Celsius, and pressures are in KPascals unless otherwise indicated.

SUMMARY OF THE INVENTION

A composition is described which is a solid product containing an intimate mixture comprising:

(a) a cationic polymer suitable for functioning as a size retention aid in a paper-making process; and, (b) a size suitable for sizing a substrate in a paper-making process.

A process for sizing a substrate is described including a process for sizing a substrate in a paper-making process including the steps of:

(a) obtaining a solid form product which is an intimate mixture of: (i) a cationic polymer suitable for functioning as a size retention aid in a paper-making process; and, (ii) a size suitable for sizing a substrate in a paper-making process.

(b) dispersing the solid product in an aqueous mixture;

(c) applying the resultant aqueous mixture to the substrate; and (d) causing the size to be fixed to the substrate.

DETAILED DESCRIPTION OF THE INVENTION

The first aspect to be discussed in the present invention is that of the cationic polymer which is suitable for functioning as a size retention aid in a paper-making process. The term paper-making process includes any one of several substrates as are later described!!!

A size retention aid, typically a cationic polymer, is a material which allows a hydrophobic sizing agent to be retained on the surface of a hydrophilic substituent (substrate) such as cellulose. That is, the cationic polymer has an affinity for the hydroxyl groups such as are pendent from the cellulose molecule thereby retaining the size on the substrate. Typically, the size, which in most cases is anionic, would not be attracted to the hydroxyl groups and therefore the cationic polymer functions to make more effective use of the size by binding the size to the size retention aid and the substrate.

The cationic polymers suitable for use in the present invention include such materials as the reaction product of the starch and a condensate of epichlorohydrin with dimethylamine or such materials substituted with ammonia. Copolymers having a more cationic charge than anionic charge are useful herein including the copolymers of cationic materials such as dimethyldiallylammonium chloride; diethyldiallylammonium chloride; 2-acrylamido-2-methylpropyltrimethylammonium chloride; 2-methacryloxy-2-ethyltrimethylammonium chloride; 2-methacryloxy-2-hydroxypropyltrimethylammonium methosulfate; trimethylmethacryloxyethylammonium methosulfate; acrylamidopropyltrimethylammonium chloride; vinylbenzyltrimethylammonium chloride; and the like. Such copolymers are described in U.S. Pat. No. 4,305,860 issued Dec. 15, 1981 to Iovine et al.

Cationic starches which may be utilized herein are described in U.S. Pat. No. 3,854,970 issued Dec. 17, 1974 to Aitken. The cationic starches described therein are binary condensates of epichlorohydrin and dimethylamine or a modified ternary condensate wherein a minor amount of up to 30% molar amount of ammonia is substituted for a like amount of dimethylamine. The starch utilized herein whether made by the process of Aitken or otherwise is preferably a pregelatinized starch, most preferably pregelatinized potato starch. Other, useful starches suggested herein corn, wheat, tapioca and rice. Further additional starches which may be converted to cationic materials useful for the present invention include those of amylose, waxy sorghum, cassava and the amylose and amylopectin fractions thereof.

Further examples of cationic starches useful in the present invention are found in U.S. Pat. No. 3,562,103 issued Feb. 9, 1971 to Moser et al and assigned to the A. E. Staley Manufacturing Company, Decatur, Ill. Cold water swelling starches of Eastman, U.S. Pat. No. 4,452,978 issued June 5, 1984, which have been made cationic are also useful herein. The Eastman starches which have not been made cationic are useful to solubilize (disperse) the size in the emulsion.

The starches of Moser et al are preferably mixed anionic/cationic starches having a slightly greater cationic charge than anionic charge. The quaternary ammonium etherifying agents include such materials as omega-haloalkyl ammonium compounds; such as 2-bromoethyl trimethyl ammonium chloride; 1-bromomethyl triethyl ammonium bromide; 2-iodoethyl triethyl ammonium chloride; vicinal-epoxyalkyl ammonium compounds, such as 2,3-epoxypropyl trimethyl ammonium chloride; 3,4-epoxybutyl triethyl ammonium bromide; 2,3-epoxybutyl methyldiethyl ammonium iodide; and vicinal-halohydroxyalkyl quaternary ammonium compounds, such as 2,3-chlorohydroxypropyl trimethyl ammonium chloride; 2,3-chlorohydroxypropyl triethyl ammonium chloride and other similar materials.

The anionic groups suggested to be added to the starches of Moser et al (U.S. Pat. No. 3,562,103) are such suitable phosphonating agents including (1) vinylphosphonates such as diethyl vinylphosphonate, dichloroethyl vinylphosphonate, (2) vicinal halohydroxyalkanephosphonates; such as 1-chloro-2-hydroxyethanephosphonic acid; 2-chloro-1-hydroxyethanephosphonic acid; 2-bromo-3-hydroxypropanephosphonic acid; methyl hydrogen 2-chloro-3-hydroxypropanephosphonate; di(N,N-diethylaminoethyl) 2-chloro-3-hydroxypropane phosphonate; diglycidyl 3-chloro-4-hydroxybutanephosphonate; (3) vicinal epoxyalkanephosphonates; such as epoxyethanephosphonic acid; 2,3-epoxypropanephosphonic acid; diethyl 2,3-epoxypropanephosphonate; 3,4-epoxybutanephosphonic acid; and (4) omega-haloalkanephosphonates such as chloromethanephosphonic acid; dimethyl bromomethanephosphonate; 3-bromopropanephosphonic acid; and the like.

Further useful cationic agents include those described in Sweeney U.S. Pat. No. 4,431,826 issued Feb. 14, 1984 such as alum, aluminum chloride, long-chain fatty amines, sodium aluminate, substituted polyacrylamide, chromic sulfate, animal glue, cationic thermosetting resins and polyamide polymers. Of particular interest are various cationic starch derivatives including primary, secondary, tertiary or quaternary amine starch derivatives and other cationic nitrogen substituted starch derivatives as well as cationic sulfonium and phosphonium starch derivatives.

The next component to be discussed is the sizing agent. Particularly valuable sizing agents of the present invention are the anhydride sizes. The present invention is primarily concerned with the anhydride sizes as these materials benefit most from being in a solid or semi-solid form. Typical anhydrides are found in U.S. Re. Pat. No. 29,960 issued Apr. 10, 1979 to Mazzarella et al. Further sizing agents are described in U.S. Pat. No. 4,514,229 issued Apr. 30, 1985 to Sato et al. Typical anhydrides which are useful include the reaction products of maleic anhydride and olefins such as octene-1; decene-1; and dodecene-1; straight-chain internal olefins such as octene-2; octene-4; decene-3; decene-5; undecene-3; undecene-5; dodecene-4; dodecene-6; tetradecene-5 and tetradecene-7. Further disclosures of sizes are maleic anhydride copolymers of straight-chain internal olefins of materials having 14 to 36 carbon atoms; preferably about 15 to about 24 carbon atoms where more than 90 mole percent of the olefins have a double bond at the 2 or higher positions with little or no branched carbon chain.

Such materials are exemplified by the maleic anhydride copolymers with n-pentadecene-2; n-pentadecene-3; n-pentadecene-6; n-hexadecene-4; n-hexadecene-5; n-hexadecene-8; n-heptadecene-3; n-heptadecene-5; n-heptadecene-7; n-octadecene-3; n-octadecene-4; n-octadecene-9; n-nonadecene-2; n-nonadecene-7; n-eicosene-4; n-eicosene-10; n-heneicosene-3; n-heneicosene-9; n-tetracosene-2; n-tetracosene-5 and n-tetracosene-11.

The dicyclopentadiene copolymers of maleic anhydride or similar materials substituted with ammonia, alkalis or amines may be utilized as a sizing agent in the present invention.

Substrates which may be sized with the compositions of the present invention include materials such as cellulose (paper) and synthetic materials such as polyamides, polyesters and polyacrylic resins, and mineral fibers such as asbestos or glass or mixtures thereof.

Typically, the weight ratio of the cationic polymer to the size is from about 1:2 to about 10:1; preferably from about 1:1 to about 4:1. The amount of cationic polymer and the size utilized in relation to the substrate are within the parameters of those typically used in sizing the particular substrate. The cationic polymer will be utilized in forming the solid product in a weight ratio to the substrate of from about 1:2000 to about 1:20; preferably from about 1:1000 to about 1:100. Further, the size will be utilized in a weight ratio to the substrate typically at from about 1:4000 to about 1:50; preferably from about 1:2000 to about 1:100.

It will be observed, that not all of the size or the cationic polymer need be included within the solid form of the present invention when sizing the paper. That is, other than the amounts of the cationic polymer and the size required to form a solid product, any necessary or desirably additional amounts of the size or the cationic polymer may be added separately to the furnish.

The solid form of the product of the invention is preferably a tablet (pellet) typically defined as a pressed item which is an intimate mixture of the cationic polymer and the size in such amounts that the normally liquid, oily size is substantially dispersed through the cationic polymer. The product may also be presented in the form of a flake or granule such as a spray-dried or freeze-dried granule. The solid form products are prepared such that the normally liquid size does not separate from the normally solid cationic polymer following preparation of the product.

A further preferred embodiment of the present invention is wherein the size is substantially encapsulated by the cationic polymer such as is obtained by a concentric encapsulation method as is known in the art. A further method of preparing the intimate mixture in the solid form is by spraying the size onto the cationic polymer.

The application of the mixture of the size and the cationic polymer to the substrate is typically at the screens or fan pump immediately prior to the dehydrating of the paper slurry e.g., cellulose.

The method and composition of the present invention is particularly effective when utilizing a pregelled starch. Further, the anhydride is far more effective in that the anhydride immediately begins to lose effect in the hot paper slurry or upon standing in the emulsion and thus by utilizing the process of the present invention, the anhydride is thoroughly mixed and presented to the substrate prior to any substantial amount of the anhydride being hydrated. Thus the anhydride is effectively maintained in the anhydride state up to the point of drying wherein the anhydride is reacted to the substrate. The reaction of the anhydride to the substrate is typically done by heating the substrate.

The following exemplifies the present invention.

EXAMPLE I

A mixture containing 10 parts of iso-hexadencenyl succinic anhydride and 30 parts of a pregelled cationic potato starch (STA-LOK 600 Starch from the A. E. Staley Manufacturing Company) is prepared as a mixture and stirred until the color is a uniform pale yellow. A tablet of the foregoing mixture is prepared by placing 8 parts of the mixture in a pellet press and applying pressure to the mixture at 20,600 KPa. A small amount of fluid is driven from the pellet at this pressure.

The tablet is then added to 400 parts of tap water and stirred for 20 minutes under moderate shear. Following the moderate shear treatment, a low shear mixer is then used to agitate the mixture for an additional 10 minutes at 1,000 rpm. Following this treatment, approximately 50 parts of the mixture is decanted and watched for oil separation over a period of 1.5 hours. No oil separation is seen and therefore, the product had been successfully emulsified for presentation to a paper substrate.

It will further be observed from utilizing the foregoing tablet in a paper-treating composition that a large degree of the size is fixed to the paper.

Substantially, similar results are obtained when the product is formed into a spray-dried or freeze-dried granule, a flake, encapsulated with the cationic polymer and the like. The emulsification properties of the product may be improved by including in the furnish about 1% by weight of a glucoside surfactant containing between 8 and 18 carbon atoms in the aglycone moiety and an average of 2 glucose units in the saccharide.

Substantially, similar results are obtained when using isooctadecenyl succinic anhydride.

EXAMPLE II

A tablet containing 3 parts of pregelled cationic potato starch and 1 part isohexadecenyl succinic anhydride size, prepared as in Example 1, is added to 96 parts of deionized water and stirred with moderate shear for 20 minutes or until the tablet has dispersed and the starch dissolved. The dispersion is transferred to a blender and emulsified for 2 minutes. The resulting emulsion is then diluted with 200 parts deionized water and stirred to ensure complete mixing.

An amount of 3 parts of the above emulsion are added to 4 parts cellulose fiber, previously slurried in 796 parts water, and mixed thoroughly. The water is then drained from the cellulose/size mixture through a screen to form a sheet of paper. The paper is pressed and dried at 105°–120° C. for 5 minutes.

The product of the invention performs exceptionally by the Hercules size test.

EXAMPLE III

A cationic starch paste is prepared by dissolving 5 parts pregelatinized cationic potato starch in 95 parts deionized water. 2.5 parts isohexadecenyl succinic anhydride is added to the starch paste and emulsified in a blender for 2 minutes. The resulting emulsion is spray dried at 176° C. inlet temperature and 121° C. outlet temperature.

The spray dried emulsion is reconstituted by slurrying 5 parts of the spray dried emulsion in 95 parts water, stirring for 40 minutes, and emulsifying in a blender for 2 minutes, followed by dilution with 400 parts water. Paper is then sized with the diluted (1%) emulsion as described in Example 2.

The product of the invention performs exceptionally by the Hercules size test.

What is claimed is:

1. A solid product containing an intimate mixture comprising:
   (a) a cationic polymer suitable for functioning as a size retention aid in a paper-making process; and,
   (b) a size suitable for sizing a substrate in a paper-making process.

2. The product of claim 1 in the form of a flake.

3. The product of claim 1 wherein the cationic polymer is a starch.

4. The product of claim 1 wherein the size is an anhydride sizing agent.

5. The product of claim 1 in the form of a tablet.

6. The product of claim 1 wherein the size is a ketene dimer size.

7. The product of claim 1 in the form of a granule.

8. The product of claim 1 wherein the weight ratio of (a) to (b) is from about 1:2 to about 10:1.

9. The product of claim 1 in the form of a spray-dried or freeze-dried granule.

10. The product of claim 1 wherein the size is a member selected from the group consisting of isohexadecenyl and isooctadecenyl anhydrides and mixtures thereof.

11. The product of claim 1 wherein the substrate is a member selected from the group consisting of cellulose, polyamides, polyesters, and polyacrylic resins, asbestos, and glass and mixtures thereof.

12. The product of claim 3 wherein the cationic polymer is a pregelatinized cationic starch.

13. The product of claim 11 wherein the substrate is cellulose.

14. The product of claim 1 wherein the size is substantially encapsulated by the cationic polymer.

15. The product of claim 8 wherein the weight ratio of (a) to (b) is from about 1:1 to about 4:1.

16. The product of claim 1 including therein alum.

17. The product of claim 1 wherein the size is sprayed onto the cationic polymer to form the solid product.

18. The product of claim 3 wherein the cationic starch also contains anionic substitution.

19. The product of claim 18 wherein the anionic substitution is a phosphate moiety.

20. The product of claim 3 wherein the starch is a potato starch.

21. The product of claim 12 wherein the starch is a potato starch.

22. A process for sizing a substrate in a paper-making process including the steps of:
   (a) obtaining a solid form product which is an intimate mixture of: (i) a cationic polymer suitable for functioning as a size retention aid in a paper-making process; and, (ii) a size suitable for sizing a substrate in a paper-making process;
   (b) dispersing the solid product in an aqueous mixture;
   (c) applying the resultant aqueous mixture to the substrate; and
   (d) causing the size to be fixed to the substrate.

* * * * *